US009042778B2

(12) United States Patent
Saitoh et al.

(10) Patent No.: US 9,042,778 B2
(45) Date of Patent: May 26, 2015

(54) POWDER REFILLING DEVICE, PROCESS CARTRIDGE AND IMAGE INCLUDING SAME, AND POWDER REFILLING METHOD

(71) Applicants: Kazuya Saitoh, Kanagawa (JP); Akio Kosuge, Kanagawa (JP); Hirokatsu Suzuki, Kanagawa (JP); Ryuji Yoshida, Kanagawa (JP); Takuya Suganuma, Kanagawa (JP); Tetsuto Ueda, Kanagawa (JP); Taichi Urayama, Kanagawa (JP); Sho Sekiguchi, Kanagawa (JP)

(72) Inventors: Kazuya Saitoh, Kanagawa (JP); Akio Kosuge, Kanagawa (JP); Hirokatsu Suzuki, Kanagawa (JP); Ryuji Yoshida, Kanagawa (JP); Takuya Suganuma, Kanagawa (JP); Tetsuto Ueda, Kanagawa (JP); Taichi Urayama, Kanagawa (JP); Sho Sekiguchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 18 days.

(21) Appl. No.: 13/930,432

(22) Filed: Jun. 28, 2013

(65) Prior Publication Data

US 2014/0027012 A1 Jan. 30, 2014

(30) Foreign Application Priority Data

Jul. 30, 2012 (JP) ..... 2012-168495
Aug. 22, 2012 (JP) ..... 2012-183416

(51) Int. Cl.

| | |
|---|---|
| ***G03G 15/08*** | (2006.01) |
| *G03G 21/12* | (2006.01) |
| *G03G 21/10* | (2006.01) |

(52) U.S. Cl.

CPC ..... *G03G 15/0867* (2013.01); *G03G 15/0834* (2013.01); *G03G 21/12* (2013.01); *G03G 21/10* (2013.01); *G03G 15/0832* (2013.01); *G03G 2215/0665* (2013.01); *G03G 15/0874* (2013.01)

(58) Field of Classification Search

CPC ..... G03G 15/08
USPC ..... 399/120
See application file for complete search history.

(56) References Cited

U.S. PATENT DOCUMENTS

| | | | | |
|---|---|---|---|---|
| 6,904,249 | B2 * | 6/2005 | Kato et al. | 399/120 |
| 7,593,674 | B2 * | 9/2009 | Matsumoto et al. | 399/262 |
| 2003/0223776 | A1 * | 12/2003 | Kato et al. | 399/120 |
| 2004/0131392 | A1 * | 7/2004 | Matsumoto et al. | 399/262 |
| 2012/0177406 | A1 * | 7/2012 | Suzuki et al. | 399/120 |
| 2014/0027012 | A1 * | 1/2014 | Saitoh et al. | 141/10 |

FOREIGN PATENT DOCUMENTS

| | | | | |
|---|---|---|---|---|
| JP | 63-256975 | | 10/1988 | |
| JP | 7-134484 | | 5/1995 | |
| JP | 1995-134484 | * | 5/1995 | G03G 15/08 |
| JP | 9-251232 | | 9/1997 | |
| JP | 2008-224820 | * | 9/2008 | G03G 15/08 |

* cited by examiner

*Primary Examiner* — Clayton E Laballe
*Assistant Examiner* — Kevin Butler
(74) *Attorney, Agent, or Firm* — Harness, Dickey & Pierce, P.L.C.

(57) ABSTRACT

A powder refilling device includes a refill powder chamber to accommodate a powder bag containing powder, an opener to open the powder bag inside the refill powder chamber, and a squeezer to squeeze the opened powder bag to discharge powder therefrom and reduce a volume of the opened powder bag.

18 Claims, 14 Drawing Sheets

POWDER REFILLING DEVICE, PROCESS CARTRIDGE AND IMAGE INCLUDING SAME, AND POWDER REFILLING METHOD

CROSS-REFERENCE TO RELATED APPLICATIONS

This patent application is based on and claims priority pursuant to 35 U.S.C. §119 to Japanese Patent Application Nos. 2012-168495 filed on Jul. 30, 2012 and 2012-183416 filed on Aug. 22, 2012, in the Japan Patent Office, the entire disclosure of each of which is hereby incorporated by reference herein.

BACKGROUND OF THE INVENTION

1. Technical Field

The present invention generally relates to a powder refilling device, a process cartridge and an image forming apparatus that use a powder refilling device, and a powder refilling method, and, more particularly, to those using a powder bag to contain powder.

2. Description of the Background Art

Electrophotographic image forming apparatuses, such as, copiers, printers, facsimile machines, plotters, or multifunction machines (or multifunction peripherals) having at least two of copying, printing, scanning, and facsimile transmission capabilities, generally form electrostatic latent images on an image bearer (i.e., photoreceptor) with laser light and develop the electrostatic latent images with charged toner into toner images. Toner images are then transferred onto sheets of recording media such as plain paper, fused, and fixed thereon. Electrophotographic image forming apparatuses are refilled with toner as toner is consumed in image development. When toner therein is consumed, process cartridges, which typically include a developing device and the like, are replaced, or the process cartridge is refilled with toner. Replacing process cartridges is relatively easy although cost is higher.

To reduce the cost, there are refillable process cartridges designed to be refilled with toner by end users or third parties (i.e., service persons). For example, packets of refill toner (i.e., toner bags) can be available for users to refill their process cartridges by themselves.

Various approaches have been tried to prevent spilling or scattering of toner when users refill their process cartridges with toner from toner bags.

For example, JP-H07-134484-A proposes a toner cartridge that includes a refill toner container, in which a thin rubber bag containing toner is disposed, and a bag breaking member to break the thin rubber bag, thereby supplying toner to the developing device. Additionally, JP-H09-251232-A proposes a toner refilling device that includes a toner bag containing refill toner and a squeezing jig. The toner bag includes a handle at an end and stitch perforations at another end, and the handle is fitted around an opening of a toner tank. When the handle is pulled, the toner bag is torn at the stitch perforations, and the squeezing jig squeezes toner contained in the toner bag into the toner tank.

Additionally, JP-H09-251232-A proposes a refill toner container that includes a bag body containing toner and a guide board unit to support the bag body. After a toner chamber of the process cartridge is refilled with toner from the bag body, the bag body is compressed and kept inside the toner chamber.

The bag body is torn using a string constructed of a thread or tape provided inside the bag body. When the string is pulled, the bottom of the bag body is opened.

SUMMARY OF THE INVENTION

In view of the foregoing, one embodiment of the present invention provides a powder refilling device to refill a powder chamber with powder contained in a powder bag. The powder refilling device includes a refill powder chamber to accommodate a powder bag containing powder, an opener to open the powder bag inside the refill powder chamber, and a squeezer to squeeze the opened powder bag to discharge powder therefrom and reduce a volume of the opened powder bag.

Another embodiment provides an image forming apparatus in which a process cartridge is removably installable. The process cartridge includes the above-described toner refilling device, and the squeezer is movable. The image forming apparatus includes a cartridge mount in which the process cartridge is mounted, and a shifting assembly to move the squeezer of the toner refilling device. The shifting assembly moves the squeezer in a direction to squeeze out toner from the toner bag into the toner chamber in conjunction with installation of the process cartridge into the image forming apparatus, and the shifting assembly returns the squeezer to an initial position in conjunction with removal of the process cartridge from the image forming apparatus.

Yet another embodiment provides a method of refilling a process cartridge with toner contained in a toner bag. The method includes placing the toner bag in a refill toner container installed in the process cartridge, opening the toner bag inside the refill toner container, and squeezing the opened toner bag to discharge toner therefrom toward a toner supply unit of the toner cartridge and reduce a volume of the opened toner bag.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
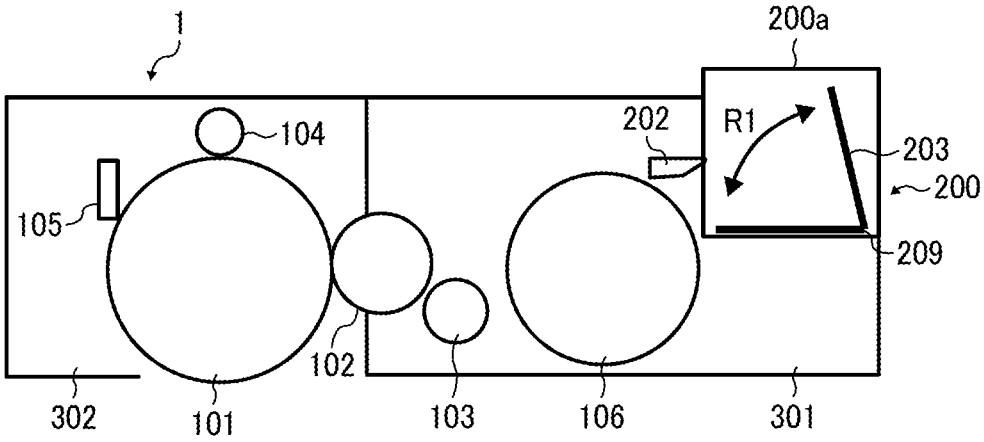
FIG. 1 is a schematic view of a process cartridge including a toner refilling device being in an initial state, according to a first embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein interpreted accordingly.

Referring now to the drawings, wherein like reference numerals designate identical or corresponding parts throughout the several views thereof, and particularly to FIG. 1, a multicolor image forming apparatus according to an embodiment of the present invention is described.

First Embodiment

Referring to FIGS. 1 through 5, a process cartridge including a toner refilling device according to a first embodiment is described below.

A process cartridge 1 includes a photoreceptor 101 serving as an image bearer, a developing roller 102, a supply roller 103 to supply toner to the developing roller 102, a charging roller 104, and a cleaning blade 105 serving as a cleaning device, and thus is a so-called all-in-one unit. An interior of the process cartridge 1 is divided into a first compartment 301 on the side of the supply roller 103 and a second compartment 302 on the side of the photoreceptor 101.

A toner container or toner refilling device 200 is provided in the first compartment 301. The developing roller 102, the supply roller 103, and a conveyance paddle 106 are provided in the first compartment 301 to supply toner from the toner refilling device 200 to the developing roller 102. The developing roller 102, the supply roller 103, the conveyance paddle 106, and the first compartment 301 together form a developing device. The supply roller 103 and the conveyance paddle 106 can serve as a toner supply unit.

A refill toner chamber 200*a*, serving as a refill powder chamber, is formed inside a casing of the toner refilling device 200 to accommodate a toner bag 201 containing refill toner, and a squeezer 203 is provided in the refill toner chamber 200*a*.

Additionally, an opener 202 to open the toner bag 201 is provided inside or outside the refill toner chamber 200*a*. Providing the opener 202 to not the toner refilling device 200 but the process cartridge 1 (in particular, the first chamber 301) is advantageous in that the number of components of the toner refilling device 200 is reduced, thereby reducing the cost.

The toner bag 201 can be, for example, formed of synthetic resin film that includes a polyethylene (PE) sheet having a thickness of about 0.02 mm to about 0.1 mm and aluminum deposited inside the PE sheet. Thus, the opener 202 can tear open the toner bag 201 easily. Synthetic resin film is advantageous over rubber in that the cost is lower.

The material and thickness of the toner bag 201 are not limited to the description above, and the toner bag 201 can be constructed of other known materials as long as the opener 202 can tear open the toner bag 201. The squeezer 203 can pivot in the direction indicated by arrow R1 shown in FIG. 1, and its lower end in FIG. 1 serves as a fulcrum. The squeezer 203 pushes and squeezes the toner bag 201 in the refill toner chamber 200*a* to supply toner leaking from the tear in the toner bag 201 to the conveyance paddle 106. The opener 202 is designed to tear open the toner bag 201 inside the refill toner chamber 200*a* depending on the relative positions of the opener 202 and the refill toner chamber 200*a*. In the second compartment 302, the charging roller 104, the developing roller 102, and the cleaning device 105 are disposed around the photoreceptor 101.

Figure 2:
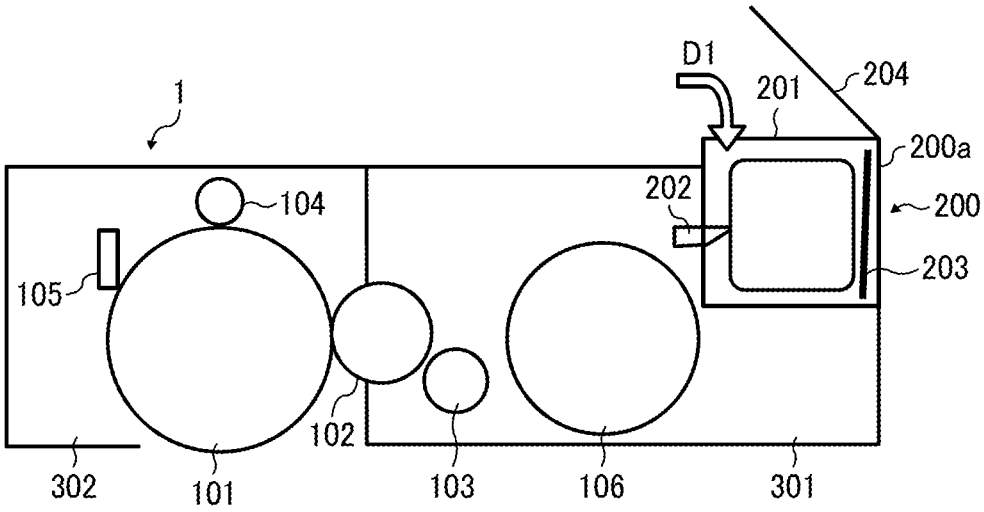
FIG. 2 is a schematic view of the process cartridge shown in FIG. 1, with a toner bag accommodated in a toner chamber.

The developing roller 102 is disposed at a boundary between the first and second compartments 301 and 302. The developing roller 102 receives toner in the first compartment 301 and transports the toner to a latent image formed on the photoreceptor 101 in the second compartment 302, thus forming a toner image. Then, a transfer device disposed downstream from the developing roller 102 in the direction in which the photoreceptor 101 rotates transfers the toner image onto a sheet of recording media. As shown in FIG. 2, a lid 204 positioned above the refill toner chamber 200*a* can be lifted and opened from the state shown in FIG. 1. Then, the toner bag 201 can be placed inside the refill toner chamber 200*a* as indicated by arrow D1 shown in FIG. 2. After the lid 204 of the refill toner chamber 200*a* is closed down, the squeezer 203 is moved in the direction indicated by arrow D2 shown in FIG. 3, thereby pushing the toner bag 201 toward the opener 202. As the toner bag 201 is pushed, an end of the opener 202 sticks into the toner bag 201, tearing or breaking the toner bag 201.

Figure 3:
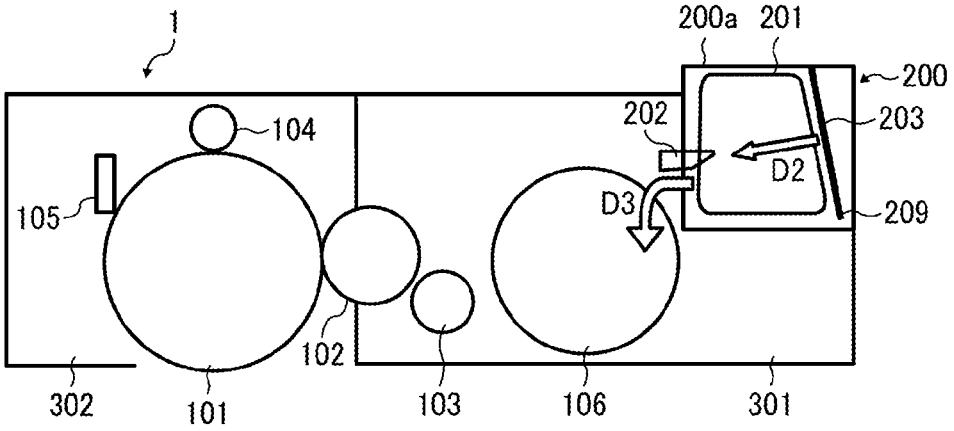
FIG. 3 is a schematic view illustrating a squeezer pushing the toner bag to an opener that tears the toner bag.

When the toner bag 201 is opened or torn, toner is pushed out therefrom to the conveyance paddle 106 in the direction indicated by arrow D3 shown in FIG. 3 and supplied to the conveyance paddle 106. The squeezer 203 presses the toner bag 201 further after toner supply is performed.

Figure 4:
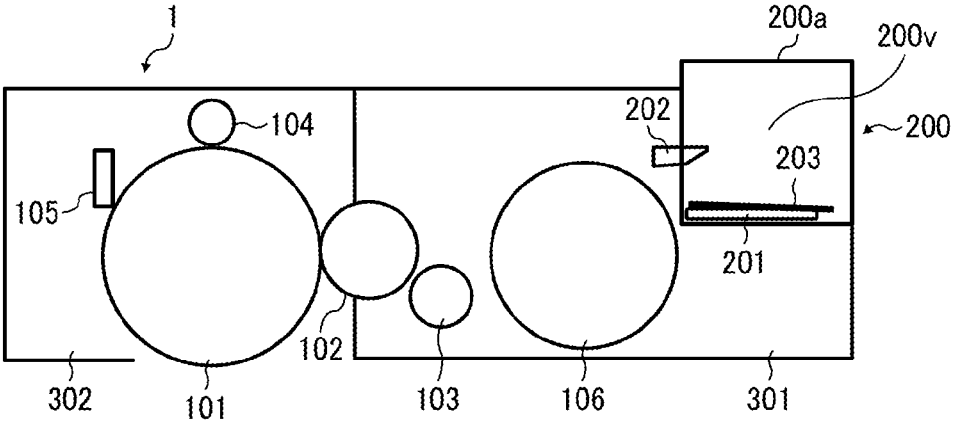
FIG. 4 is a schematic view illustrating a state subsequent to the state shown in FIG. 3, and the toner bag pressed by the squeezer is minimized.
Figure 5:
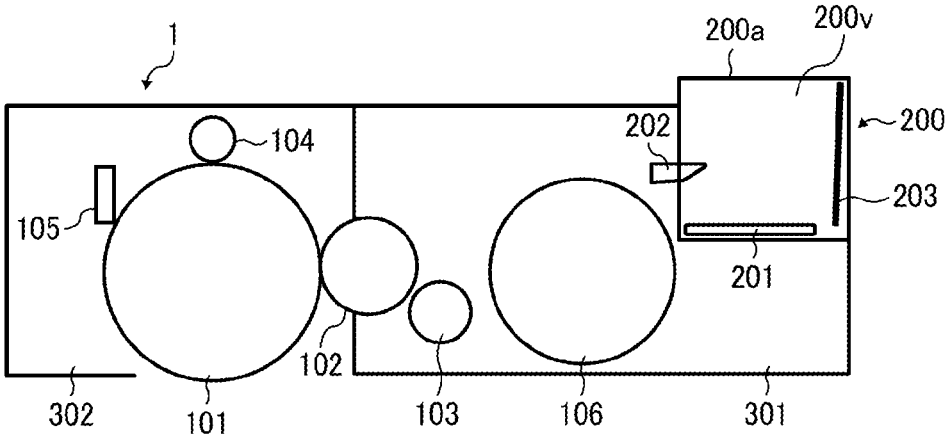
FIG. 5 illustrates the squeezer being at an initial position, and a space is created above the compressed toner bag.

The squeezer 203 positioned as shown in FIG. 4 (i.e., a squeezing position") can minimize the toner bag 201 and make space to accommodate another toner bag 201 is created inside the refill toner chamber 200*a*. Subsequently, the squeezer 203 returns to the initial position as shown in FIG. 5, securing a compartment 200*v* inside the refill toner chamber 200*a* to accommodate another toner bag 201.

The above-described processes of placing the toner bag 201 in the refill toner chamber 200*a*, tearing open the toner bag 201, and pressing (squeezing) the toner bag 201 are repeated. When no space is left for another toner bag 201, the operational life of the process cartridge 1 is deemed expired. At that time, the user replaces the process cartridge 1 with another one. It is to be noted that, although the squeezer 203 minimizes the toner bag 201 in dimensions in the description above, it is not necessary to minimize the toner bag 201 as long as the dimensions are reduced, which is similar in the following embodiments.

Needless to say, minimizing the toner bag 201 is efficient to make full use of the capacity of the toner refilling device 200. Additionally, although the squeezer 203 pushes the toner bag 201 to the opener 202 to tear the toner bag 201 in the description above, alternatively, the opener 202 may move to the toner bag 201. In the present embodiment, it does not matter which of the two moves as long as the opener 202 and the toner bag 201 move relatively to each other.

Figure 6:
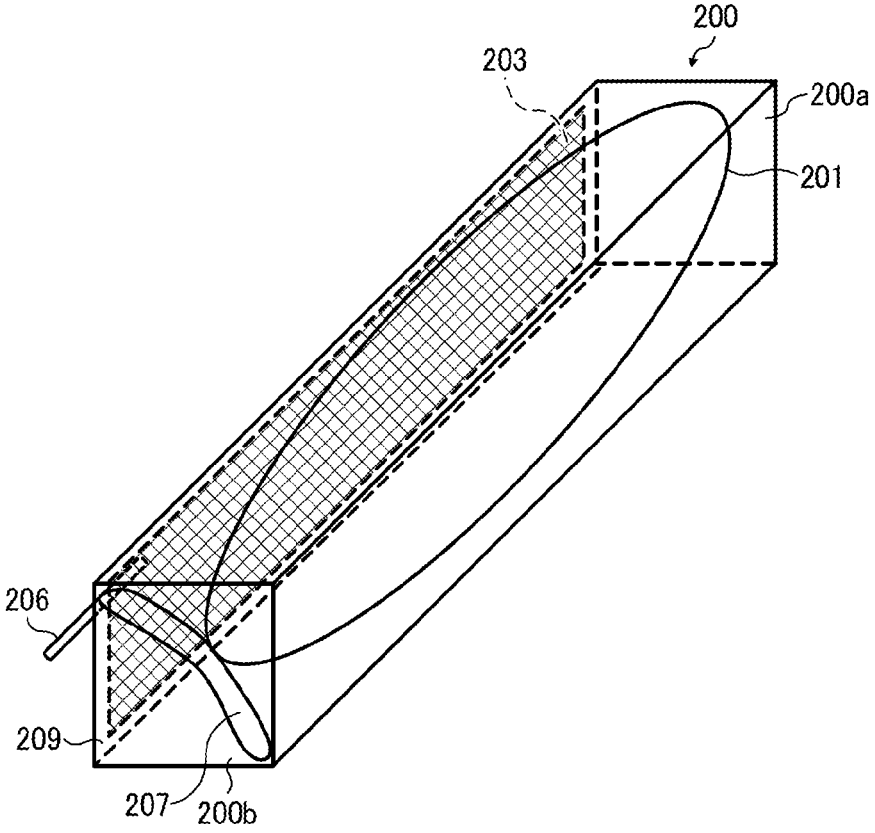
FIG. 6 is a perspective view illustrating a configuration of a toner refilling device according to the first embodiment.
Figure 7:
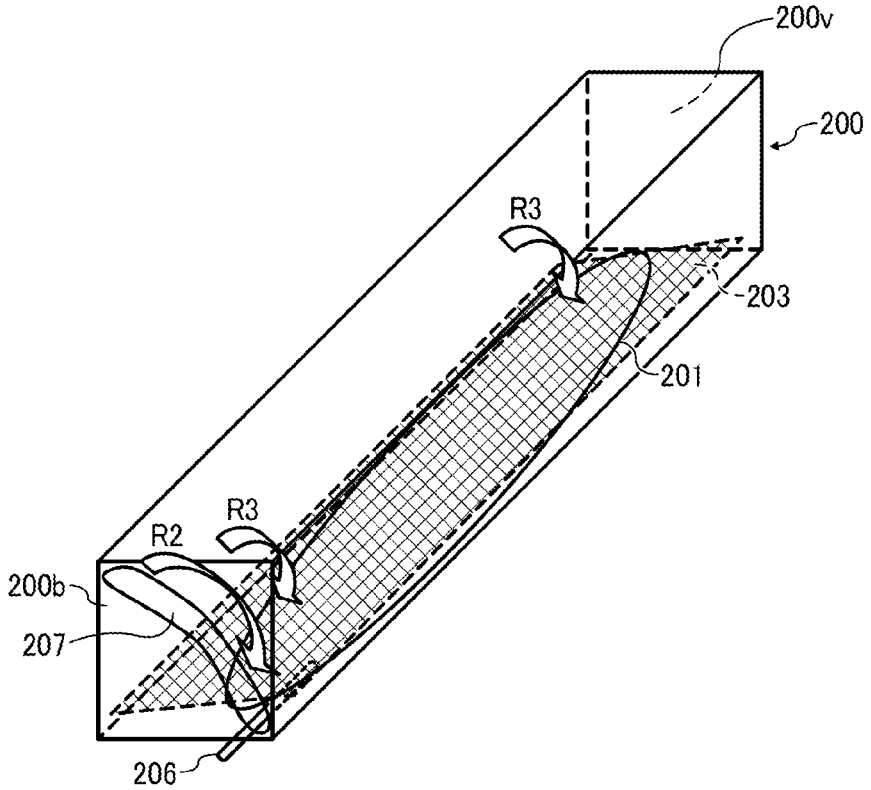
FIG. 7 is a perspective view illustrating the toner refilling device according to the first embodiment in the state shown in FIG. 4.

FIGS. 6 and 7 are perspective views illustrating a configuration of the toner refilling device 200 according to the first embodiment. In FIGS. 6 and 7, reference character 200*b* represents a side wall of the toner refilling device 200 on the proximal side in these drawings. In FIG. 6, the toner refilling device 200 is shaped into a rectangular parallelepiped, and the refill toner chamber 200*a* is formed therein. Inside the refill toner chamber 200*a*, the squeezer 203 is disposed along an inner wall and pivotable about the fulcrum 209. A handle 206 to move the squeezer 203 is provided to an upper end of a proximal side of the squeezer 203 in FIG. 6.

A guide slot 207 is formed in the side wall 200*b* of the toner refilling device 200 on the proximal side in FIGS. 6 and 7. The handle 206 penetrates the guide slot 207 and projects outside the toner refilling device 200 to move along the guide slot 207. With this configuration, the handle 206 can be operated from outside the process cartridge 1.

The guide slot 207 is shaped into an arc that is one fourth of a circle centered about the fulcrum 209. Thus, the handle 206 and the guide slot 207 together form a shifting assembly to move the squeezer 203.

The handle 206 can be moved along the guide slot 207 in the direction indicated by arrow R2 to the position shown in FIG. 7, and the squeezer 203 moves in the direction indicated by arrow R3. With this configuration, the toner bag 201 is pushed in the direction indicated by arrow R3 and reduced in volume.

The handle 206 can be returned along the guide slot 207 to the position (i.e., an initial position) shown in FIG. 6, and thus the space for receiving another toner bag 201 can be secured in the refill toner chamber 200*a*. Thus, subsequent refilling of the process cartridge 1 with toner becomes feasible. It is to be noted that, to prevent leak of toner from the guide slot 207, it is advantageous that clearance between the guide slot 207 and the handle 206 is covered with a sponge, rubber, or brush member that does not hinder the movement of the handle 206.

It is to be noted that the opener 202 is omitted in FIGS. 6 and 7 for simplicity. The state shown in FIG. 6 corresponds to FIG. 2, and the state shown in FIG. 7 corresponds to FIG. 4.

Figure 12:
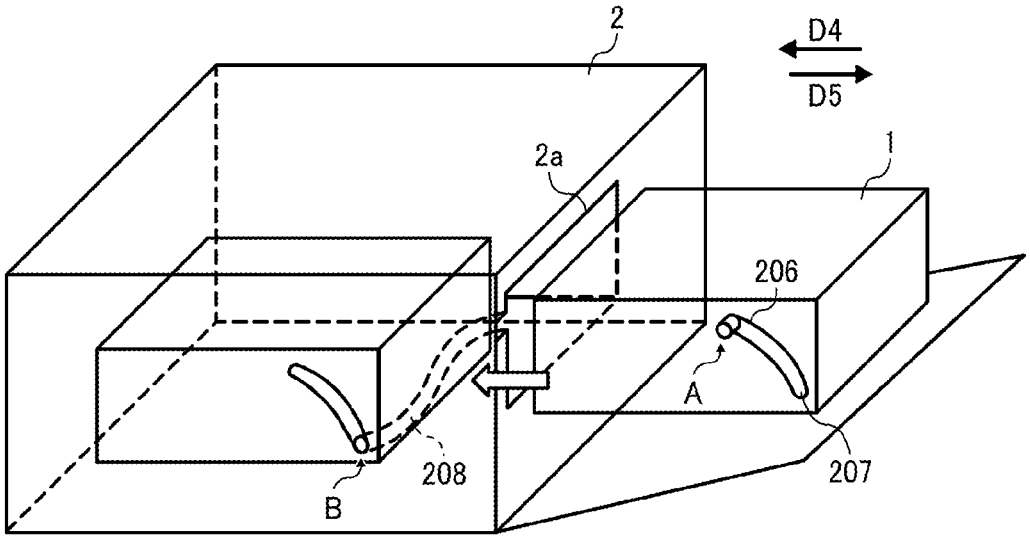
FIG. 12 is a perspective view illustrating installation of the process cartridge shown in FIG. 6 into an image forming apparatus.

FIG. 12 is a perspective view illustrating a shifting assembly to move the squeezer 203 as the process cartridge 1 is mounted in and removed from an image forming apparatus 2.

In the configuration shown in FIG. 12, the image forming apparatus 2 includes a cartridge mount 2*a*, and a cam groove 208 is formed in an inner side wall of the cartridge mount 2*a* such that the handle 206 can be moved by the cam groove 208.

Specifically, the handle 206 being at the initial position A (i.e., one end of the guide slot 207) penetrates the side wall 200*b* of the toner refilling device 200 (shown in FIG. 6) and the process cartridge 1 and appears outside the process cartridge 1. In installation of the process cartridge 1 into the image forming apparatus 2, an end of the handle 206 thus projecting outside is fitted in the cam groove 208 shaped as shown in FIG. 12.

When the process cartridge 1 is inserted into the image forming apparatus 2 as indicated by arrow D4, the end of the handle 206 moves downward as indicated by arrow R2 shown in FIG. 7, regulated by a curve of the cam groove 208 and the guide slot 207. When the handle 206 reaches a position B (i.e., the other end of the guide slot 207), the toner bag 201 torn by the opener 202 is fully squeezed by the squeezer 203 (shown in FIG. 7).

By contrast, when the process cartridge 1 is pulled out from the image forming apparatus 2 as indicated by arrow D5, the handle 206 moves upward along the curve of the cam groove 208 and the guide slot 207. With this operation, the handle 206 and the squeezer 203 returns to the initial position A, securing the compartment 200*v* for another toner bag 201 in the refill toner chamber 200*a*. Then, the toner bag 201 is put in the refill toner chamber 200*a*, and the process cartridge 1 is installed in the image forming apparatus 2 again. Thus, the process cartridge 1 can be refilled with toner again.

This configuration can obviate manual work of users since the handle 206 can be moved in conjunction with installation and removal of the process cartridge 1 from the image forming apparatus 2.

Second Embodiment

Although the above-described first embodiment employs a single squeezer 203 that returns to the initial position from the squeezing position to secure the compartment 200*v* for receiving subsequent toner bags 201, a toner refilling device 2002 according to a second embodiment employs multiple squeezers 203, that is, first to nth squeezers 203-1 through 203-*n* ("n" is an integer equal to or greater than "2").

Figure 8:
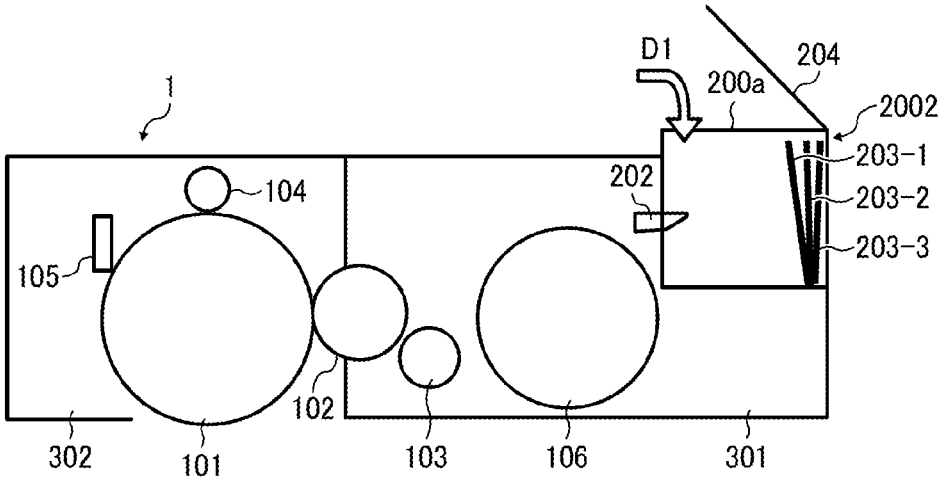
FIG. 8 is a schematic view of a toner refilling device according to a second embodiment, mounted in a process cartridge.
Figure 9:
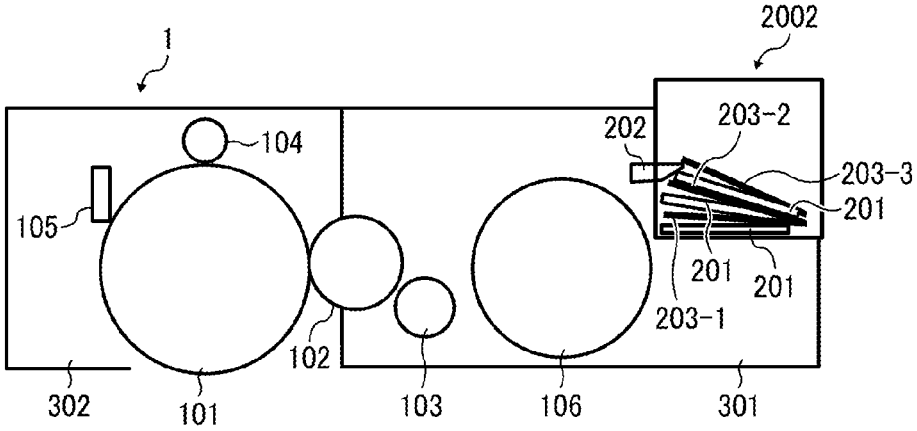
FIG. 9 is a schematic view illustrating the toner refilling device shown in FIG. 8, in which multiple toner bags are sequentially compressed by multiple squeezers.

In the configuration shown in FIGS. 8 and 9, first, second, and third squeezers 203-1, 203-2, and 203-3 (also collectively "squeezers 203") are provided. In this configuration, after squeezing the first toner bag 201, the first squeezer 203-1 is kept at that position. Then, the second toner bag 201 is put in the refill toner chamber 200*a* above the first squeezer 203-1. To refill the process cartridge 1 with toner from the second toner bag 201, the second squeezer 203-2 is moved similarly.

After the second squeezer 203-2 squeezes out toner from the second toner bag 201 and reduces the toner bag 201 in volume, the third toner bag 201 is put in the refill toner chamber 200*a*. Then, the third squeezer 203-3 is moved similarly. It is to be noted that, although the three squeezers 203 are illustrated in FIGS. 8 and 9, the number of times the process cartridge 1 is refillable depends on the size of the refill toner chamber 200*a*, the thickness of the toner bag 201, and the like.

FIG. 9 illustrates a state after the last squeezer 203 (the third squeezer 203-3 in FIGS. 8 and 9) performs the last refilling.

In this configuration, the process cartridge 1 is deemed to be at the end of operational life when no or almost no toner remains in the process cartridge 1, and the last squeezer 203 is at the position shown in FIG. 9. The process cartridge 1 being in this state is replaced.

Figure 10:
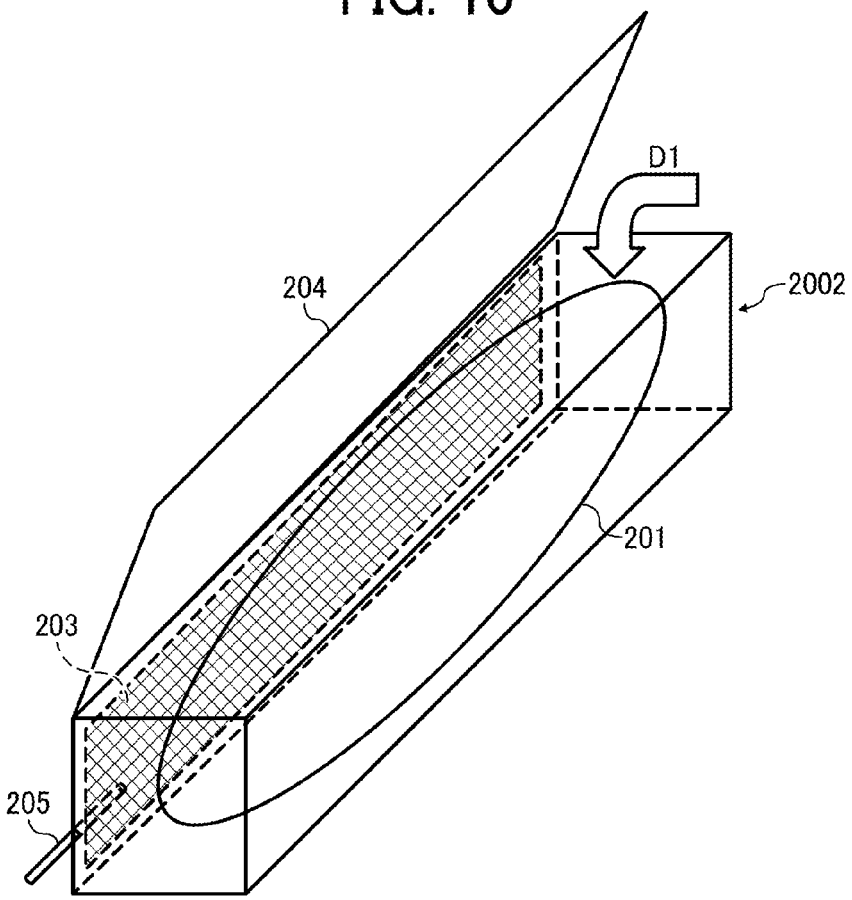
FIG. 10 is a perspective view illustrating a configuration of the toner refilling device according to the second embodiment, corresponding to FIG. 8.
Figure 11:
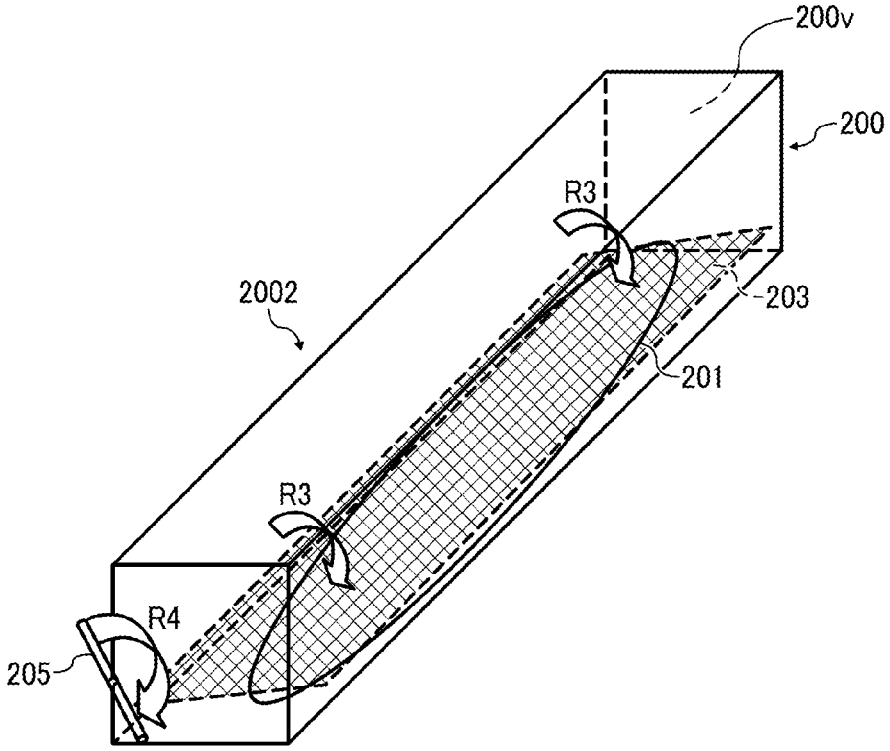
FIG. 11 is a perspective view illustrating the toner refilling device according to the second embodiment in the state shown in FIG. 9.

FIGS. 10 and 11 are perspective views illustrating a configuration of the toner refilling device 2002 according to the second embodiment. The toner refilling device 2002 further includes a retainer 205 to retain the squeezer 203. Although urged by a biasing member, the squeezer 203 is retained at the initial position shown in FIG. 10 by the retainer 205. The multiple squeezers 203 are disposed in such a state.

The retainer 205 can be operated from outside the process cartridge 1. Specifically, the retainer 205 can be rotated in the direction indicated by arrow R4 from the position shown in FIG. 10 to release the squeezer 203. With this operation, the urged squeezer 203 rotates as indicated by arrow R3, thereby pressing the toner bag 201 to the state shown in FIG. 11. Thus, the toner bag 201 can be reduced in volume.

It is to be noted that, although only a single squeezer 203 and a single retainer 205 are illustrated in FIGS. 10 and 11 for simplicity, the multiple squeezers 203 and the multiple retainers 205 are provided as described above, and number of times the process cartridge 1 is refillable equals to the number of the squeezers 203 and the retainers 205. It is to be noted that the opener 202 is omitted in FIGS. 10 and 11 for simplicity. Other than the above-described differences, the present embodiment is similar to the first embodiment.

In the above-described first and second embodiments, as shown in FIGS. 6 and 10, respectively, operation of the squeezer 203 is triggered by the handle 206 and the retainer 205, which can be operated from outside the process cartridge 1. The operation can be triggered either manually by users or by an activation device including a driving source.

Other than the above-described differences, the present embodiment is similar to the first embodiment.

As described above, the following effects can be attained by the embodiments described above.

1) The toner refilling device 200 includes the refill toner chamber 200*a* to accommodate a single or multiple toner bags 201 containing refill toner, the opener 202 to tear open the toner bag 201 inside the refill toner chamber 200*a*, and the squeezer 203 to squeeze out toner from the toner bag 201 opened by the opener 202. Since the squeezer 203 compresses the toner bag 201, from which toner is discharged, to reduce the volume of the toner bag, the compartment 200*v* for accommodating another toner bag can be created. In this configuration, opening and squeezing of the toner bag 201 can be performed inside the refill toner chamber 200*a*. Accordingly, toner can be prevented from scattering and spilling outside the refill toner chamber 200*a* during toner refilling.

Therefore, the above-described aspect of the present specification can reduce or eliminate downtime caused for cleaning of the site or changing clothes when toner scatters or is spilled.

Although process cartridges may be brought to the manufacturer or the like to be refilled, it takes time before the refilled process cartridge is returned to the user, thus causing downtime, and the cost increases. According to the above-described aspect of the present specification, cost can be lower with downtime reduced since the refilling operation can be executed by users themselves not by third parties. Additionally, the risk of business information leaks can be reduced since it is not necessary to invite others in the user's site for the refilling operation.

2) Since the compartment 200*v* is created by compressing the toner bag 201, toner refilling can be repeated multiple number of times until the remaining space of the compartment 200*v* becomes smaller than another toner bag 201.

Since the compartment 200*v* can be created by the squeezer 203 provided inside the refill toner chamber 200*a*, a toner refilling device capable of inhibiting spilling and scattering of toner can be provided at a lower cost. Minimizing the toner bag 201 is advantageous in that the compartment 200*v* can be made maximum, thus increasing the number of times the process cartridge 1 is refilled.

3) When the multiple squeezers 203 are provided, it is not necessary to return the squeezer 203 to the initial position after the toner bag 201 is squeezed, and the compartment 200*v* created above that squeezer 203 can accommodate another toner bag 201.

4) Since the squeezer 203 is provided with the handle 206 to move the squeezer 203, squeezing out toner from the toner bag 201 and creation of compartment 200*v* can become easier.

5) When the end of the handle 206 is positioned outside the refill toner chamber 200*a*, the user can operate the handle 206 manually.

6) In the toner refilling device 2002 that includes the retainer 205 to retain the squeezer 203 at the initial position, for example, the squeezer 203 can be urged to the direction in which the squeezer 203 squeezes the toner bag 201, and squeezing the toner bag 201 can be started easily by releasing the squeezer 203. In the configuration including the multiple squeezers 203, toner can be supplied toward the conveyance paddle 106 by simply releasing the squeezer 203.

7) Providing the toner refilling device 200 in the process cartridge 1 enables refilling the process cartridge 1.

8) In the first and second embodiments described above, the used toner bags 201 are kept inside the refill toner chamber 200*a*, and the operational life of the process cartridge 1 expires when the space remaining in the refill toner chamber 200*a* is insufficient for another toner bag 201. Since the entire process cartridge 1 is replaced when the toner refilling device 200 is full of empty toner bags 201, the refill toner chamber 200*a* is not opened for replacement. Accordingly, toner does not spill or scatter during replacement of the process cartridge 1.

9) With the process cartridge 1 serving as the image forming unit, an image forming apparatus in which toner refilling is easier with scattering and spilling of toner inhibited can be attained.

10) The image forming apparatus 2 includes the cam groove 208 to move the squeezer 203 in the direction to squeeze out toner from the toner bag 201 when the process cartridge 1 is mounted in the image forming apparatus 2. Additionally, when the process cartridge 1 is removed from the image forming apparatus 2, the squeezer 203 can be returned to the initial position by the cam groove 208, thus securing the compartment 200*v* inside the refill toner chamber 200*a*. Accordingly, refilling the process cartridge 1 and preparation for refilling can be attained by insertion and removal of the process cartridge 1 from the image forming apparatus 2.

Third Embodiment

In a third embodiment described below, a powder containing bag (i.e., a toner bag) without stitch perforations is installed in the process cartridge, and the opener largely opens the toner bag inside the process cartridge to refill the process cartridge with toner. In the present embodiment, the toner bag includes a handle to be grasped and pulled by users when the opened toner bag is removed from the process cartridge. The toner bag can be wound around the handle and folded, thus reduced in size. Accordingly, when the toner bag is collected, the user's hand can be kept clean.

It is to be noted that identical or corresponding parts throughout the embodiments described below are given an identical reference character, and redundant descriptions are omitted.

Figure 13:
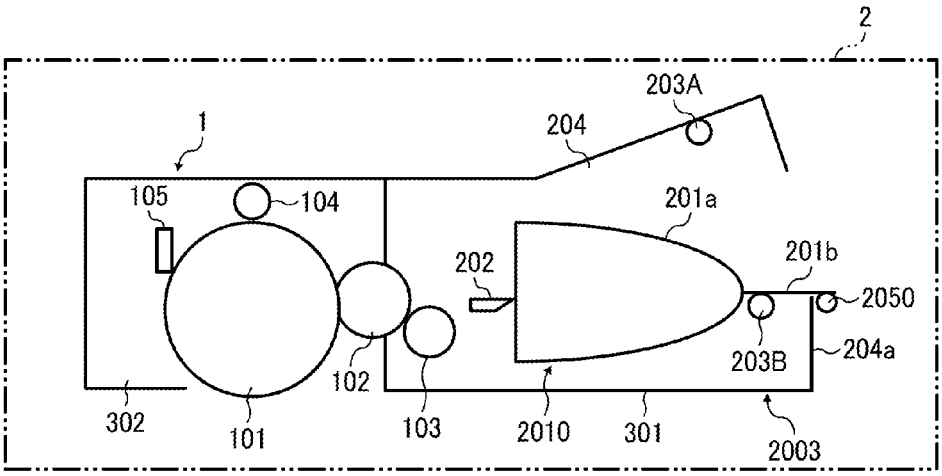
FIG. 13 is a schematic diagram illustrating a toner bag installed in a process cartridge according to a third embodiment, with a lid open.
Figure 14:
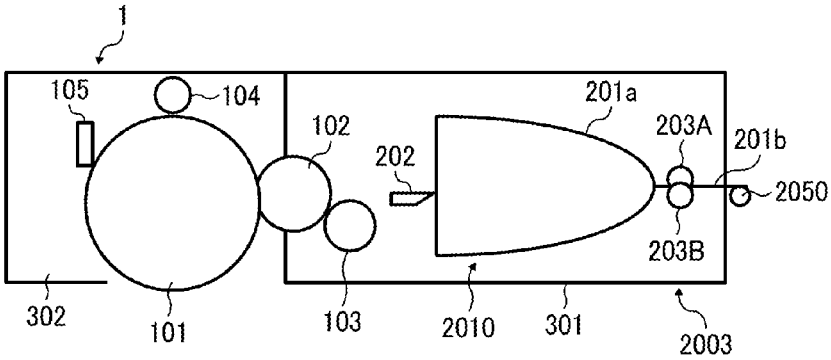
FIG. 14 is a schematic diagram illustrating the toner bag accommodated in the process cartridge shown in FIG. 13, with the lid closed.

FIGS. 13 and 14 illustrate a toner bag 2010 according to the present embodiment, being set in the process cartridge 1 usable in the image forming apparatus 2. In the present embodiment, the first compartment 301 on the side of the supply roller 103 serves as a toner bag storage to accommodate the toner bag 2010. It is to be noted that the image forming apparatus 2 is substantially larger than the process cartridge 1 although represented by a relatively small rectangle schematically in FIGS. 13 and 14.

In the first compartment 301, the opener 202 and first and second squeezers 203A and 203B are provided in addition to the toner bag 2010, the developing roller 102, and the supply roller 103. Toner discharged from the toner bag 2010 can be supplied to the developing roller 102.

The opener 202 cuts in, breaks, or tears open the toner bag 2010 to refill the first compartment 301 with toner contained in the toner bag 2010. Accordingly, the opener 202 has a sharp corner that contacts the toner bag 2010 to cut therein. The opener 202 may include a blade to reliably cut the toner bag 2010. The first compartment 301, the opener 202, and the first and second squeezers 203A and 203B together form a powder refilling device 2003.

The toner bag 2010 includes a bag body 201*a* serving as a containing portion, a flap or flat portion 201*b* serving as a pulled portion designed not to contain powder, and a handle 2050 positioned at an end of the flap 201*b*. When the toner bag 2010 is accommodated installed in the process cartridge 1, the handle 2050 is positioned outside to be pulled by the user to remove the toner bag 2010 from the process cartridge 1. Additionally, the flap 201*b* of the toner bag 2010 is interposed between the first and second squeezers 203A and 203B. Therefore, in the present embodiment, the first squeezer 203A is disposed on an inner side of the lid 204 for opening the first compartment 301.

It is to be noted that, in FIGS. 13 through 16, the lid 204 is hinged on the left and can open from the right in the drawings (hereinafter "opening side"). With this arrangement, as shown in FIG. 14, when the lid 204 is closed and the handle 2050 is pulled out, the bag body 201*a* of the toner bag 2010 is squeezed in the nip between the first and second squeezers 203A and 203B, thereby squeezing out toner from the bag body 201*a* into the first compartment 301.

When one of the first and second squeezers 203A and 203B is a deformable roller capable of deforming when pressed against the other, sealing can be secured, and discharge of toner into the first compartment 301 can be facilitated. Alternatively, both the first and second squeezers 203A and 203B may be rollers that are not deformable. It is to be noted that the first and second squeezers 203A and 203B are not limited to rollers, but may be any members capable of squeezing the toner bag 2010 to discharge toner therefrom when the toner bag 2010 is sandwiched thereby and the handle 2050 is pulled. For example, the first and second squeezers 203A and 203B may be rubber blades.

Figure 15:
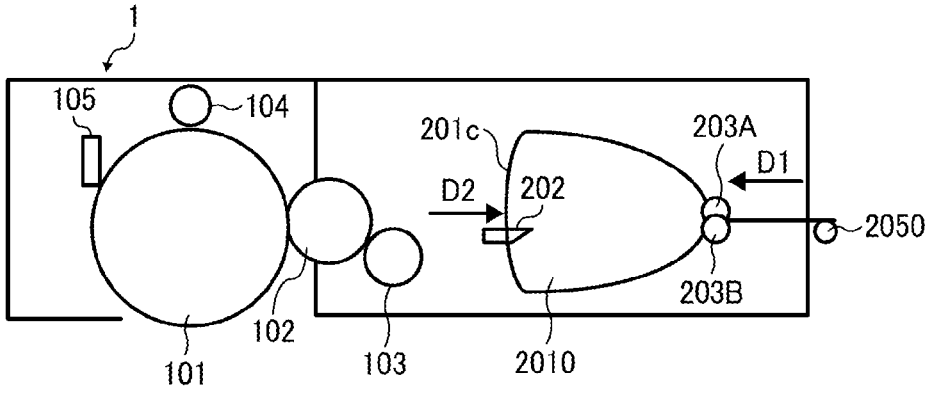
FIG. 15 is a schematic view illustrating a pair of squeezers being pushed to an opener to refill the process cartridge with toner from the toner bag.
Figure 16:
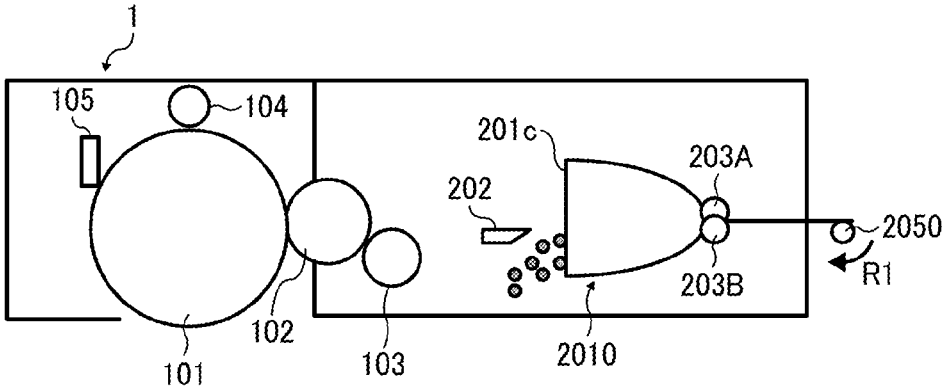
FIG. 16 is a schematic view illustrating the toner bag opened by the opener to discharge toner into the process cartridge.

Referring to FIGS. 15 and 16, descriptions are given below of refilling the process cartridge 1 with toner from the toner bag 2010 according to the third embodiment.

To refill the toner cartridge 1, the lid 204 is opened as shown in FIG. 13. When the toner bag 2010 is placed inside the first compartment 301, the handle 2050 at the end of the flap 201*b* is disposed outside through the clearance between the lid 204 and a housing 204*a* of the process cartridge 1. The lid 204 is closed as shown in FIG. 14 from the state shown in FIG. 13. Subsequently, as shown in FIGS. 15 and 16, the first and second squeezers 203A and 203B are pushed in the direction indicated by arrow D1 from outside the process cartridge 1 by a mechanism. In conjunction with the first and second squeezers 203A and 203B moving in the direction indicated by arrow D1, the opener 202 moves in the direction D2 shown in FIG. 15 and approaches the toner bag 2010.

As the first and second squeezers 203A and 203B move, the internal pressure of the toner bag 2010 increases, and the toner bag 2010 bulges. Further, the opener 202 sticks into a rear end 201*c* (on the left in FIG. 15) of the bulging toner bag 2010, thus making a hole or tear therein. When the toner bag 2010 bulges, the opener 202 can stick therein easily. After the opener 202 makes the hole in the toner bag 2010, a mechanism moves the opener 202 in the longitudinal direction of the toner bag 2010 perpendicular to a direction in which sheets are transported in the image forming apparatus 2 to widen the hole in the rear end 201*c* of the toner bag 2010 so that toner can easily flow out into the first compartment 301. In the present embodiment, sheets are transported from the right to the left in FIGS. 13 to 16, and the longitudinal direction of the toner bag 2010 is perpendicular to the surface of the paper on which those drawings are drawn.

The opener 202 can be a cutter with a blade or, alternatively, a needle or an acicular or spinate member. The powder refilling device 2003 may includes a single opener 202, or multiple cutters or needle-shaped members may be arranged in the direction perpendicular to the sheet conveyance direction. Either configuration can be employed as long as it can form a relatively large opening in the toner bag 2010.

By contrast, when the first and second squeezers 203A and 203B are moved in the direction indicated by arrow D1 shown in FIG. 15, the handle 2050 is stopped by the housing 204*a* of the process cartridge 1 (the opening side of the lid 204). Thus, the handle 2050 is not pulled inside the process cartridge 1. Accordingly, the toner bag 2010 can be pulled out from the first compartment 301 using the handle 2050.

The handle 2050 is formed with a rod that is circular in cross section, for example. The handle 2050 is pulled while the flap 201*b* and the bag body 201*a* of the toner bag 2010 are wrapped around the circular rod, serving as the handle 2050, in the direction indicated by arrow R1 in FIG. 16. When the toner bag 2010 is pulled to the outside, the interior thereof is compressed vertically by the first and second squeezers 203A and 203B. Consequently, the first and second squeezers 203A and 203B squeezes out toner from the opening formed in the toner bag 2010 into the first compartment 301.

The empty toner bag 2010 is reeled in by the handle 2050, thus reduced in size, and removed from the process cartridge 1. As the toner bag 2010 is thus rolled up, toner remaining therein or adhering to the inner face thereof can be wrapped inside. Accordingly, in removal of the toner bag 2010, toner smear on user's hands can be eliminated or alleviated.

Figure 17:
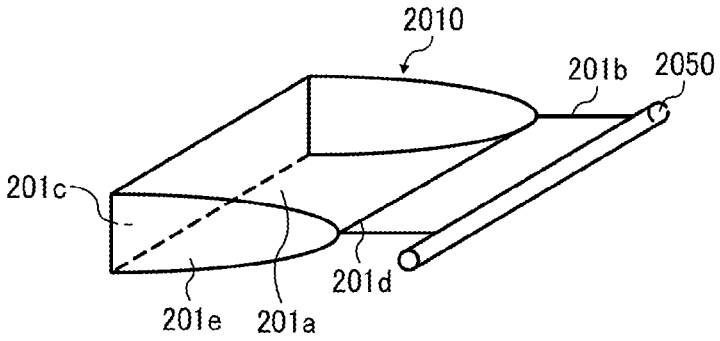
FIG. 17 is a perspective view illustrating a configuration of the toner bag according to the third embodiment.

FIG. 17 is a perspective view illustrating a configuration of the toner bag 2010.

In FIG. 17, the toner bag 2010 includes the bag body 201*a* to contain toner, the flap 201*b* (pulled portion) extending from an end 201*d* of the bag body 201*a*, and the handle 2050 at the end of the flap 201*b* opposite the bag body 201*a*. Referring to FIG. 17, the bag body 201*a* is outlined by the rear end 201*c* and curved surfaces that are symmetrical vertically. The curved surfaces are connected to each other at the end 201*d*. Thus, the bag body 201*a* is shaped like a vane or blade on a cross section parallel to the sheet conveyance direction, and the flap 201*b* extends from the end 201*d* of the vane shape.

Each of the curved surfaces of the bag body 201*a* and the flap 201*b* can be made a continuous surface. For example, by bonding two film sheets at the end 201*d* of the bag body 201*a*, the curved surfaces of the bag body 201*a* and the flap 201*b* are monolithic. Such a configuration can secure the strength.

The side surfaces 201*e* and the rear end 201*c* can be either continuous or separate. When the side surfaces 201*e* and the rear end 201*c* are bonded to the curved surfaces, the bag body 201*a* having a desired capacity for containing toner can be produced.

The arrangement in which the flap 201*b* is nipped between the first and second squeezers 203A and 203B can facilitate discharge of almost all toner in the bag body 201*a* into the process cartridge 1. The rod-shaped handle 2050 is advantageous in that the toner bag 2010 can be reeled thereby and reduced in size. However, the shape of the handle 2050 is not limited thereto.

The toner bag 2010 can be formed of synthetic resin film that includes a polyethylene (PE) sheet having a thickness of about 0.02 mm to about 0.1 mm and aluminum deposited inside the PE sheet. Accordingly, the opener 202 can cut or tear the toner bag 2010 easily. The material and thickness of the toner bag 2010 are not limited to the description above, and the toner bag 2010 can be constructed of other known materials as long as the opener 202 can tear open the toner bag 2010.

Figure 18:
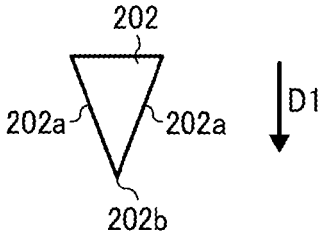
FIG. 18 is a plan view of the opener according to the third embodiment.

FIG. 18 is a plan view illustrating a configuration of the opener 202 according to the third embodiment. The opener 202 shown in FIG. 18 has an acute edge 202*b* that is triangular on the plan view. When the opener 202 is shaped as shown in FIG. 18, blades 202*a* can be provided to both sides of the opener 202 so that the toner bag 2010 can be torn more easily. However, the blade 202*a* can be provided only in on the side to which the opener 202 is slid in the longitudinal direction. Additionally, reciprocating the opener 202 along the rear end 201*c* of the toner bag 2010 can ensure that the opener 202 tears the toner bag 2010.

Figure 19:
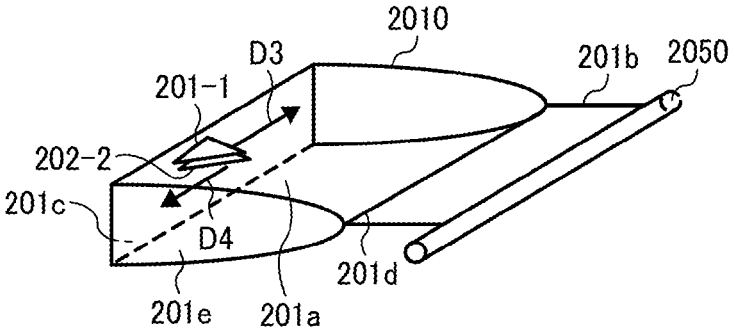
FIG. 19 is a perspective view illustrating movement of the opener to open the toner bag.
Figure 20:
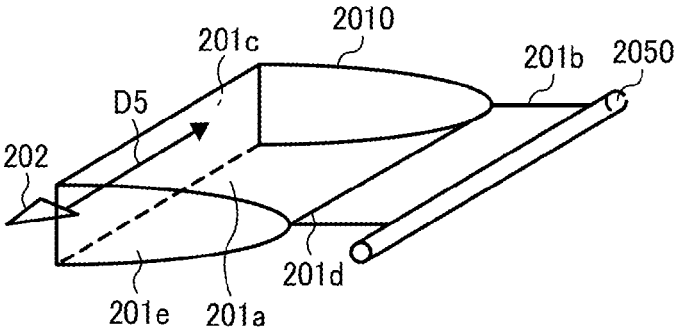
FIG. 20 is a perspective view illustrating movement of the opener in another manner.

Referring to FIGS. 19 and 20, a method of cutting the toner bag 2010 is described below.

In the arrangement shown in FIG. 19, two openers 202-1 and 202-2 having a configuration similar to that shown in FIG. 18 are arranged vertically and disposed facing a center portion of the rear end 201*c* of the toner bag 2010 in the longitudinal direction of the rear end 201*c* (indicated by arrows D3 and D4). After the openers 202-1 and 201-2 overlapping each other stick in the toner bag 2010 as shown in FIG. 15, the openers 202-1 and 202-2 are slid in the opposite directions as indicated by arrows D3 and D4. With this operation, the toner bag 2010 (the rear end 201*c* in particular) can be cut a given length in the longitudinal direction of the rear end 201*c*.

In the arrangement shown in FIG. 20, the opener 202 having a configuration similar to that shown in FIG. 18 is disposed facing a longitudinal end of the rear end 201*c* of the toner bag 2010. After the opener 202 sticks in the toner bag 2010 as shown in FIG. 15, the opener 202 is moved to the other longitudinal end as indicated by arrow D5 shown in FIG. 20. With this operation, the toner bag 2010 (the rear end 201*c* in particular) can be cut a given length in the longitudinal direction of the rear end 201*c*.

Fourth Embodiment

Descriptions are given below of a fourth embodiment in which a used toner bag is covered with a toner bag cover connected to a discharge opening when the used toner bag is removed from the process cartridge.

Figure 21:
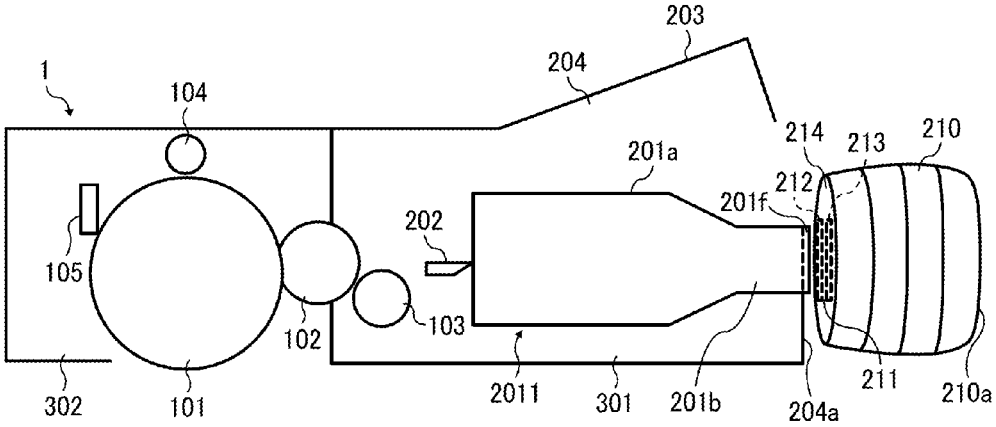
FIG. 21 is a schematic view of a toner bag according to a fourth embodiment, accommodated inside the toner cartridge.

FIG. 21 is a schematic view of a toner bag 2011 according to the fourth embodiment, contained inside the toner cartridge 1.

The process cartridge 1 according to the fourth embodiment is similar to that according to the third embodiment except the first and second squeezers 203A and 203B, and identical components are given identical reference characters, thus descriptions thereof omitted.

The toner bag 2011 includes a bag body 201*a* to contain toner and a pulled portion 201*f* positioned at the end of the flap 201*b* not for containing toner. As shown in FIG. 21, the pulled portion 201*f* is positioned outside the process cartridge 1 similarly to the handle 2050 (shown in FIGS. 13 to 17) of the toner bag 2010 according to the third embodiment.

The toner bag 2011 removed from the process cartridge 1 is collected in a toner bag cover 210. Therefore, a slit 211 is formed in one end of the toner bag cover 210 (in particular, an end face 214 facing the process cartridge 1 in FIG. 21), and the pulled portion 201*f* is inserted into the slit 211. The end face 214 is hereinafter referred to as "connection face 214". The connection face 214 of the toner bag cover 210 is connected to the housing 204*a* of the process cartridge 1 on the opening side of the lid 204. That is, an opening is formed in the housing 204*a* to insert and remove the toner bag 2011 into and from the process cartridge 1. When the toner bag cover 210 is connected thereto, the opening formed in the housing 204*a* can be sealed with the connection face 214 to prevent or inhibit toner in the first compartment 301 from leaking through the connection therebetween.

The toner bag cover 210 includes a pair of clamps 212 and 213 serving as squeezers to sandwich the pulled portion 201*f* from both sides, and the slit 211 is formed between the clamps 212 and 213. The bag body 201*a* can be sandwiched between the clamps 212 and 213 when the pulled portion 201*f* nipped in the slit 211 is pulled into the toner bag cover 210.

As the toner bag 2011 is pulled out from the process cartridge 1 with the bag body 201*a* nipped by the clamps 212 and 213, toner inside the bag body 201*a* can be pushed out by the clamps 212 and 213. Accordingly, toner can be squeezed out from the toner bag 2011 into the first compartment 301, that is, the process cartridge 1, in conjunction with removal of the toner bag 2011. Thus, the clamps 212 and 213 have a capability similar to that of the first and second squeezers 203A and 203B according to the third embodiment.

Therefore, when one of the clamps 212 and 213 is a deformable roller similarly to the third embodiment, sealing can be secured, and discharge of toner into the first compartment 301 can be facilitated.

Additionally, to suppress leak of toner, the pulled portion 201*f* of the toner bag 2011 and the slit 211 preferably have an identical or similar length.

Figure 22:
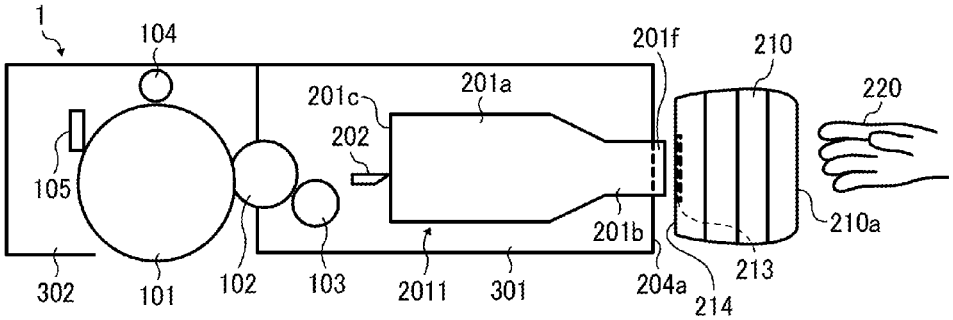
FIG. 22 is a schematic view illustrating a state in which a pulled portion of the toner bag is inserted in a slit formed in a toner bag cover in the fourth embodiment.
Figure 23:
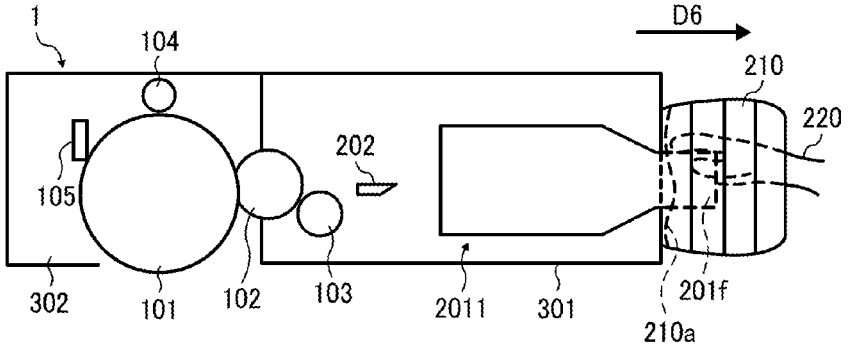
FIG. 23 is a schematic view of the toner bag according to the fourth embodiment, and toner bag is pulled out from the process cartridge.
Figure 24:
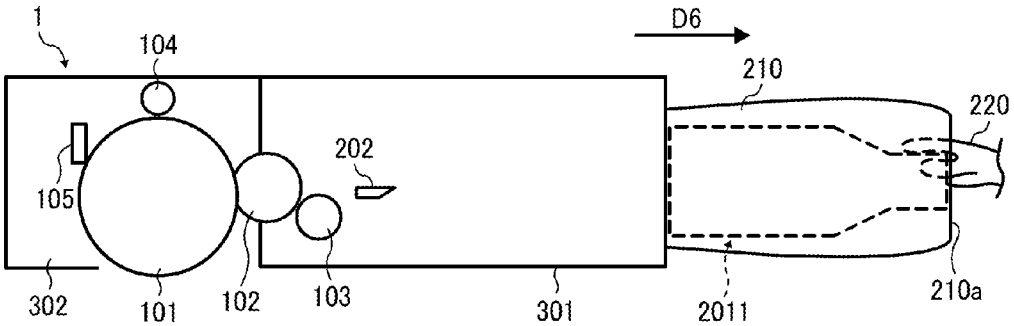
FIG. 24 is a schematic diagram illustrating the toner bag contained in a toner bag cover according to the fourth embodiment.

Referring to FIGS. 22 through 24, descriptions are given below of refilling the process cartridge 1 according to the fourth embodiment.

To refill the process cartridge 1, as shown in FIG. 21, the lid 204 is opened, and the toner bag 2011 is placed in the first compartment 301. At that time, the pulled portion 201*f* at the end of the flap 201*b* is disposed outside the process cartridge 1 through the clearance between the lid 204 and the housing 204*a*. The lid 204 is closed from the state shown in FIG. 21. Subsequently, the slit 211 formed in the toner bag cover 210 is aligned with the pulled portion 201*f* of the toner bag 2011 as shown in FIG. 22, and the pulled portion 201*f* is inserted into the slit 211.

It is to be noted that the toner bag cover 210 is shrunk in FIGS. 21 and 22, and users can push his/her hand 220 into the toner bag cover 210 from a rear end 210*a* to the connection face 214 and grip the pulled portion 201*f* of the toner bag 2011. The material and construction of the toner bag cover 210 are determined such that the toner bag cover 210 can shrink and the user can grip the toner bag 2011 via the toner bag cover 210. Although the toner bag cover 210 is not necessarily shrinkable, the shrinkable toner bag 2011 can be easily handled and disposed after the toner bag 2011 is contained therein.

When the toner bag cover 210 is attached to the process cartridge 1 in the manner shown in FIG. 22, the rear end 201*c* of the toner bag 2011 contacts the end of the opener 202. In this state, the toner bag 2011 can be cut as the opener 202 moves in the longitudinal direction of the toner bag 2011. The opener 202 in the present embodiment can have a configuration similar to that shown in FIGS. 18 through 20.

After the rear end 201*c* is thus cut and the toner bag 2011 is opened, the user puts his/her hand 220 into the toner bag cover 210 from the rear end 210*a* and grips the pulled portion 201*f*. Then, the user pulls out the pulled portion 201*f* from the process cartridge 1 as indicated by arrow D6 shown in FIG. 23.

As the toner bag 2011 passes through the nip between the clamps 212 and 213, toner contained in the toner bag 2011 can be squeezed out from the rear end 201*c* (shown in FIG. 22) into the process cartridge 1. The toner bag 2011 is pulled out until the toner bag 2011 is fully covered with the toner bag cover 210.

After the toner bag 2011 is fully covered with the toner bag cover 210 as shown in FIG. 24, the connection face 214 of the toner bag 2011 is disengaged from the housing 204*a* in which the opening for the toner bag 2011 is formed. After the toner bag 2011 is received into the toner bag cover 210, the slit 211 (shown in FIG. 21) is smeared with toner, and thus the slit is covered with a cap. Alternatively, the toner bag cover 210 may includes a seal to cover the slit 211. Yet alternatively, the slit 211 may be folded inside and bonded to an outer face of the toner bag cover 210 such that the surface of the slit 211 is not exposed.

Figure 25:
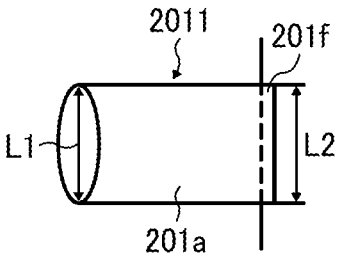
FIG. 25 is a schematic view of a toner bag having a diameter equal to or shorter than a pulled end from which the toner bag is pulled out from the process cartridge.
Figure 26:
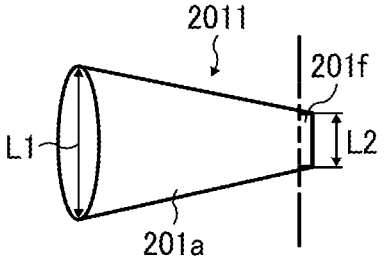
FIG. 26 is a schematic view of a toner bag having a diameter longer than a pulled end from which the toner bag is pulled out from the process cartridge.

FIGS. 25 and 26 are schematic views of the toner bag 2011 according to the present embodiment.

The toner bag 2011 includes the bag body 201*a* for containing toner and the pulled portion 201*f* not for containing toner. In the configuration shown in FIGS. 25 and 26, the pulled portion 201*f* can serve as the flap 201*b* disposed at one end of the bag body 201*a*. That is, the pulled portion 201*f* is positioned at one end of the bag body 201*a* in FIGS. 25 and 26. Alternatively, the pulled portion 201*f* may be provided at the end of the flap 201*b* as shown in FIGS. 21 and 22. As described above, the pulled portion 201*f* is nipped by the clamps 212 and 213. As the pulled portion 201*f* being in this state is pulled out, almost all toner contained in the bag body 201*a* can be squeezed out, refilling the process cartridge 1 with the toner.

Referring to FIG. 25, reference character L1 represents a diameter of the toner bag 2011, and L2 represents a length of the end of the pulled portion 201*f* from which the toner bag 2011 is pulled out. Although the material is not limited to specific materials when the diameter L1 is equal to or smaller than the length L2 (L1≤L2) as shown in FIG. 25, the toner bag 2011 is constructed of an elastic and flexible material when the diameter L1 is greater than the length L2.

Other than the above-described differences, the present embodiment is similar to the third embodiment.

Fifth Embodiment

Descriptions are given below of a fifth embodiment in which equally spaced holes (i.e., sprocket holes) are formed in both end portions of a toner bag, and the toner bag is squeezed to discharge toner inside the process cartridge using the holes. While the toner bag is reeled up using the holes, toner can be squeezed out by squeezers from the toner bag into the process cartridge.

Figure 27:
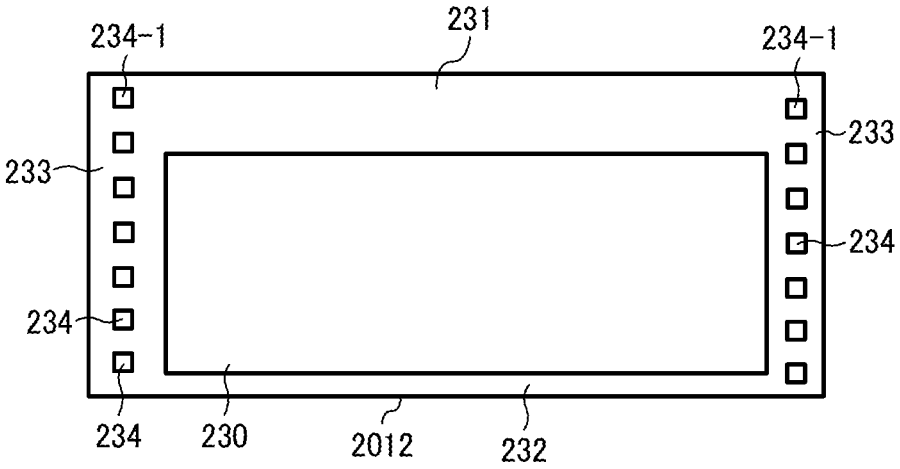
FIG. 27 is a front view of a toner bag according to a fifth embodiment.
Figure 28:
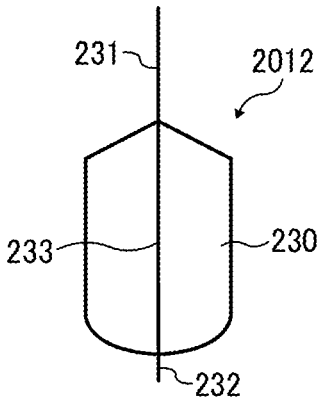
FIG. 28 is a side view of the toner bag shown in FIG. 27.

FIGS. 27 and 28 are respectively a front view and a side view of a toner bag 2012 according to the fifth embodiment. The toner bag 2012 according the present embodiment is constructed of flexible, deformable thin film such as plastic film. The toner bag 2012 includes a containing portion 230 that is bulging and positioned in a center area of the toner bag 2012 as shown in FIG. 27. The toner bag 2012 further includes film portions 231 and 232 respectively positioned in an upper part and a lower part of the toner bag 2012 and lateral end portions 233 positioned on the lateral sides in FIGS. 27 and 28. In the configuration shown in FIG. 27, a line of holes 234 is formed in each of the end portions 233. It is to be noted that reference numeral 234-1 represents the hole 234 on the top in FIG. 27. The containing portion 230 is surrounded by the upper and lower film portions 231 and 232, and the lateral end portions 233.

Figure 29:
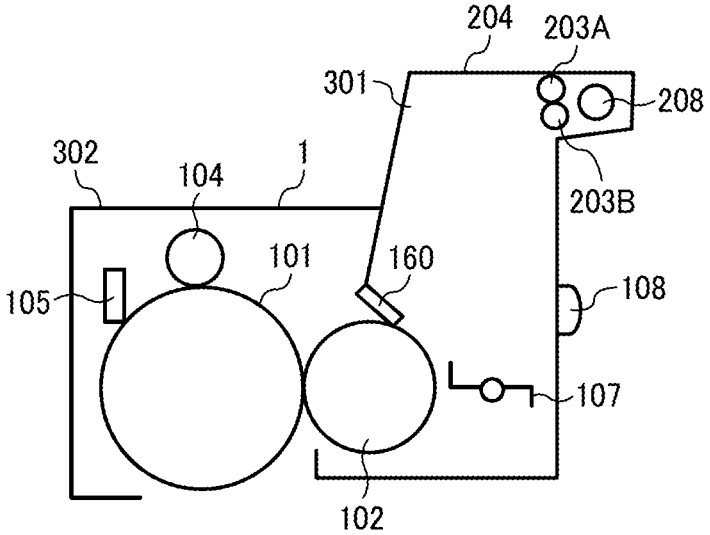
FIG. 29 is a cross-sectional view illustrating a schematic configuration of the process cartridge according to the fifth embodiment.

FIG. 29 is a cross-sectional view illustrating a schematic configuration of the process cartridge 1 according to the fifth embodiment.

The process cartridge 1 according to the fifth embodiment includes the first and second compartments 301 and 302, and the developing roller 102 and a regulation blade 160 are positioned on the boundary therebetween. The regulation blade 160 regulates the thickness of developer (i.e., toner) on the surface of the developing roller 102.

Further, an agitation paddle 107 is provided in the first compartment 301. The first squeezer 203A (i.e., a squeezing roller) similar to that in the third embodiment is provided to the back side of the lid 204 above the first compartment 301 to expose an upper side of the first compartment 301. Additionally, a reel shaft 208 to reel the toner bag 2012 and the second squeezer 203B to sandwich the toner bag 2012 with the first squeezer 203A are provided in the first compartment 301.

Additionally, a slidable lever 108 projects outside the first compartment 301 to move the opener 202 (for example, shown in FIG. 13 although not shown in FIG. 29) having a configuration similar to that in the third or fourth embodiments. Similarly to the third and fourth embodiments, the opener 202 is designed to move in the longitudinal direction of the toner bag 2012 (laterally in FIG. 27) to tear open the containing portion 230.

Figure 30:
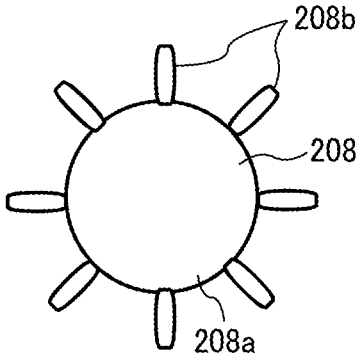
FIG. 30 is a front view of a reel shaft shown in FIG. 29.

FIG. 30 is a front view of the reel shaft 208 shown in FIG. 29.

The reel shaft 208 includes a shaft body 208*a* and projections 208*b*. In the direction perpendicular to the sheet conveyance direction, the shaft body 208*a* is longer than the longitudinal side of the toner bag 2012. The shaft body 208*a* is positioned in an end portion of the first compartment 301 on the opening side of the lid 204 as shown in FIG. 29. The shaft body 208*a* is supported by a bearing and projects outside the housing of the process cartridge 1 to be rotated by a handle.

The projections 208*b* project radially from an outer circumferential surface of the shaft body 208*a*. On the long side of the shaft body 208*a*, the projections 208*b* are positioned to face the lines of holes 234 formed in the end portions 233, and the circumferential positions of the projections 208*b* match the intervals between the holes 234 in the vertical direction in FIG. 27. For example, the number of the projections 208*b* is eight in the configuration shown in FIG. 30. As the shaft body 208*a* rotates, the projections 208*b* spaced in the circumferential direction can enter the holes 234 sequentially, and the reel shaft 208 can reels in the toner bag 2012 reliably. The projecting length of the projections 208*b* is designed to reel and hold the multiple toner bags 2012, the number of which is preset.

The first and second squeezers 203A and 203B are configured to nip the toner bag 2012 therebetween and squeeze out toner from the tear formed in the toner bag 2012 similarly to those in the third embodiment. The relation between the holes 234 and the projections 208*b* is similar to that between sprocket holes and a gear or toothed wheel.

Figure 31:
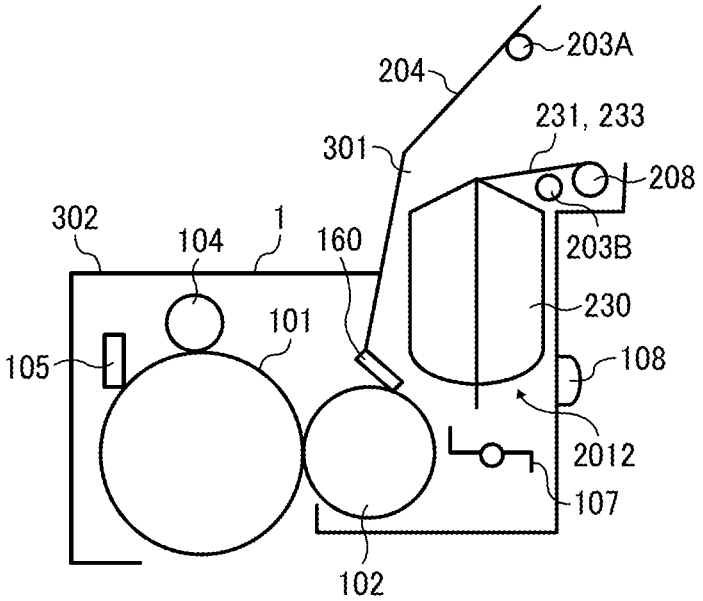
FIG. 31 illustrates the toner bag installed in the process cartridge according to the fifth embodiment.

FIG. 31 illustrates the toner bag 2012 installed in the process cartridge 1 according to the fifth embodiment.

Referring to FIG. 31, when a toner end sensor detects that no toner remains in the process cartridge 1 or the amount of toner remaining is below a threshold, the user removes the process cartridge 1 from the image forming apparatus 2 to put the toner bag 2012 into the process cartridge 1. The user opens the lid 204 on the upper side of the process cartridge 1 and puts the toner bag 2012 therein.

As the lid 204 is opened, the first squeezer 203A is disengaged from the second squeezer 203B, and a clearance is secured therebetween. It is to be noted that the first and second squeezers 203A and 203B have a length sufficient to sandwich the entire containing portion 230 in the longitudinal direction.

In this state, the user can put the toner bag 2012 inside the first compartment 301, insert the projections 208*b* of the reel shaft 208 into the holes 234-1 on the top (shown in FIG. 27) in the lateral end portions 233, and close the lid 204. Then, the upper film portion 231 of the toner bag 2012 is interposed between the first and second squeezers 203A and 203B. At that time, the opener 202 (shown in FIG. 13) contacts the containing portion 230 of the toner bag 2012 although not shown in FIG. 31.

Subsequently, as the lever 108 is slid in the axial direction of the reel shaft 208 (longitudinal direction of the toner bag 2012), the opener 202 moves in that direction, tearing the containing portion 230. Thus, a relatively large area of the toner bag 2012 can be opened substantially along its long side. With this operation, toner flows out from the containing portion 230 into the process cartridge 1. Further, the handle is rotated, thereby rotating the reel shaft 208 to reel in the toner bag 2012. At that time, all or almost all toner can be discharged from the toner bag 2012 since the relatively large area of the toner bag 2012 is opened, and the toner bag 2012 is nipped between the first and second squeezers 203A and 203B.

Thus, in the present embodiment, the toner bag 2012 is opened and reeled in with the lid 204 of the process cartridge 1 closed, and all or almost all toner can be discharged from the toner bag 2012 into the process cartridge 1. Accordingly, when the user refills the process cartridge 1 with toner, the exterior or surroundings of the process cartridge 1 are not smeared with toner, or smear with toner can be reduced. Similarly, smear with toner of the user's hand can be prevented or alleviated.

It is to be noted that one of more of the components, such as the photoreceptor 101, the development roller 102, and the like, of the process cartridge 1 can wear gradually as the process cartridge 1 is used for long time. That is, the operational life of the process cartridge 1 is limited, and an identical process cartridge 1 is not used for ever even if refillable repeatedly. The number of the toner bags 2012 put in a single toner cartridge 1 is determined according to the operational life. Therefore, the projections 208*b* of the reel shaft 208 have a length corresponding to the number of the toner bags 2012 usable in a single toner cartridge 1. With this configuration, the degraded process cartridge 1 unfit for continued use is neither refilled nor used further.

Additionally, the reel shaft 208 may be provided with a detector to detect that the thickness or diameter of the reel shaft 208 becomes greater than a threshold after the predetermined number of toner bags 2012 are wrapped around. According to such detection, a message to advise the user of replacement of the process cartridge 1 can be displayed. For example, the detector can be constructed of a feeler and an optical sensor to detect the movement of the feeler that is pushed when the thickness of the reel shaft 208 reaches or exceeds the threshold. In this configuration, when to replace the process cartridge 1 can be detected easily using the optical sensor.

It is to be noted that the present embodiment is designed such that the user opens the containing portion 230 of the toner bag 2012 using the lever 108 provided to the process cartridge 1. Alternatively, the process cartridge 1 may be designed such that the toner bag 2012 is opened in conjunction with installation into the image forming apparatus of the process cartridge 1 in which an unopened toner bag 2012.

Specifically, for example, when the process cartridge 1 is designed to be inserted in the axial direction of the reel shaft 208 into the image forming apparatus, and the lever 108 is designed to be hooked on the body of the image forming apparatus, the toner bag 2012 can be opened long in the longitudinal direction in installation of the process cartridge 1.

Although the reel shaft 208 (in particular, the handle thereof) is rotated manually in the present embodiment, alternatively, the reel shaft 208 may be designed to be rotated using a driving force transmitted from the image forming apparatus. In this case, for example, a gear is provided to an end of the shaft body 208*a* of the reel shaft 208, and the image forming apparatus includes a gear to engage the gear on the shaft body 208*a*.

It is to be noted that, although the description above concerns the process cartridge 1 including the photoreceptor 101, the developing device, the charging roller 104, and the cleaning device (cleaning blade 105), alternatively, the above-described features of the embodiments can adapt to a process cartridge that includes the developing unit only, or the developing device and at least one of the above-described components of the process cartridge 1.

As described above, the following effects can be attained by above-described aspects of the present specification.

1) According to an aspect of the present specification, the powder bag such as the toner bag 2010, 2011, or 2012 including the containing portion to contain powder (i.e., toner), such as the powder bag body 201*a* or the containing portion 230, is accommodated inside the first compartment 301 serving as a powder chamber, the opener 202 disposed in the first compartment 301 is designed to linearly cut the powder bag to open the powder bag, and the squeezers, such as the first and second squeezers 203A and 203B (collectively "squeezers 203") or the clamps 213 and 214, are designed to forcibly discharge toner from the powder bag 2010 into the first compartment 301. Therefore, the powder bag can be opened inside the first compartment 301 reliably, toner can forcibly discharged into the first compartment 301, and scattering of toner and toner smear on user hands can be suppressed.

According to the above-described aspect of the present specification, toner can be fully discharged from the toner bag by the squeezers compared with a case in which the toner bag is simply cut. Additionally, toner can be better prevented from remaining inside the toner bag compared with a case in which toner is discharged from the toner bag not forcibly but under its own weight. Since the empty toner bag can be reduced in volume, the empty toner bag is not cumbersome inside the process cartridge.

The above-described aspect of the present specification is advantageous over a configuration in which stitch perforation is formed in the toner bag such that the toner bag is torn at the stitch perforation when the toner bag is pulled out because the stitch perforation may be broken, causing toner leak, white the toner bag is transported or stored. Further, in such a configuration, as the toner bag is pulled out, the internal pressure increases, and the stitch perforation is torn, causing toner to scatter on or adhere to the outer face of the toner bag or user's hands. By contrast, according to the above-described aspect of the present specification, the toner bag is opened inside the toner cartridge, and thus user's hands can be kept clean during the refilling operation and while or after the toner bag is pulled out.

Although the toner bag may be torn with a thread, such a configuration typically requires disposing the thread at a predetermined position inside the toner bag and welding the thread on the toner bag when the end of the toner bag is bonded together. Additionally toner adhering to the thread can be transferred to the surroundings or the user hands after the thread is pulled out. By contrast, the configuration according to the above-described aspect of the present invention can offer simpler toner bags and inhibit toner scattering and smear.

2) According to another aspect, the squeezers 203 are designed to sandwich the toner bag 2010 therebetween and discharge toner from the toner bag 2010 as the toner bag 2010 moves, the first compartment 301 is openably closable by the lid 204, and the toner bag 2010 is placed into the first compartment 301 when the lid 204 is opened, with the flap 201*b* (or pulled portion) exposed outside the process cartridge 1 or the apparatus. When the lid 204 is closed, the flap 201*b* is nipped by the squeezers 203. Then, the squeezers 203 squeeze out toner from the bag body 201*a* opened by the opener 202 as the toner bag 2010 is pulled out from the side of the flap 201*b*. Therefore, the effects similar to those attained by the aspect 1) can be attained.

3) The squeezers 203 are respectively provided to the lid 204 and inside the process cartridge or the apparatus to face each other. The flap 201*b*, at the end of which the handle 2050 is provided, is sandwiched between the squeezers 203*s* when the lid 204 is closed. Accordingly, after the lid 204 is closed, the squeezers 203 can be operated immediately to refill the process cartridge.

4) When the opener 202 is designed to move, a relatively large opening can be formed in the toner bag 2010.

5) When the squeezers 203 are constructed of a pair of elastic rollers, the toner bag 2010 can be pulled out more easily. When the rollers are elastic, a nip can be formed therebetween, thus securing and facilitating discharge of toner into the first compartment 301.

6) When the lid 204 is closed, the squeezers 203 can move toward the opener 202, pushing the bag body 201*a* and toner therein to the opener 202, and thus the toner bag 2010 can be opened. With this configuration, a greater amount of toner can be discharged into the first compartment 301.

7) The handle 2050 provided at the end of the flap 201*b* (pulled portion) is blocked by the outer face of the lid 204 or the housing when the squeezers 203 move toward the opener 202. Accordingly, the toner bag 2010 can be inhibited from moving to the squeezers 203, thus obviating the need of a retainer to retain the toner bag 2010 in the first compartment 301.

8) According to another aspect, the handle 2050 is shaped like a rod having a diameter uniform in the longitudinal direction, and the toner bag 2010 can be wound around the outer circumference of the handle 2050 when pulled out. Accordingly, the empty toner bag 2010 can be reduced in size and disposed easily.

9) According to another aspect, the toner refilling device includes the toner bag cover 210, in which the slit 211 is formed to receive the pulled portion 201*f* of the toner bag 2011 into the toner bag cover 210, the connection face 214 to connect the slit 211 to the housing 204*a* on the opening side of the lid 204, and the clamps 212 and 213 (squeezers) are provided to the toner bag cover 210 adjacent to the slit 211. Accordingly, the toner bag 2011 can be collected inside the toner bag cover 210 when the toner bag 2011 is pulled out with the bag body 201*a* clamped between the clamps 212 and 213. Simultaneously, toner can be pushed by the clamps 212 and 213 and discharged from the toner bag 2011 into the first compartment 301 in conjunction with the movement of the toner bag 211 being pulled out. This configuration can attain the effects similar to those attained by the aspect 1).

10) With the connection face 214, the toner bag cover 210 can connect to the housing 204*a* in a sealed state, thus inhibiting toner from scattering from the connection therebetween while the toner bag 2011 is pulled out and thereafter.

11) According to another aspect of the present specification, the toner bag 2012 includes the containing portion 230, and the multiple holes 234 spaced regularly are formed along both lateral sides of the toner bag 2012. The reel shaft 208 includes the multiple projections 208*b* regularly spaced in the circumferential direction of the reel shaft 208 and is rotated in the direction to reel in the toner bag 2012, and toner is forcibly pushed by the squeezers 203 out from the toner bag 2012. This configuration can attain the effects similar to those attained by the aspect 1). Reliable discharge of toner can be attained at a lower cost since, at that time, the toner bag 2012 can be reeled using the relation between sprocket holds and a gear.

12) According to another aspect, the length of the shaft body 208*a* of the reel shaft 208 depends on the number of toner bags reeled thereby, and the number of toner bags reeled is determined according to the operational life of the process cartridge. With this configuration, use of the process cartridge whose operational life has expired can be avoided, thus securing image quality.

13) According to another aspect of the present specification, the toner bag 2012 is formed with flexible film and includes the containing portion 230 and the lateral end portions 233 in which the multiple holes 234 spaced regularly are formed. Accordingly, the toner bag 2012 can be collected inside the first compartment 301 using the holes 234. Forming a toner containing portion at a center and forming multiple holes are relatively easy. Thus, the configuration of the toner bag 2012 is simple, and the cost can be lower.

14) Another aspect of the present specification provides the toner bag cover 210 to house the toner bag 2011 outside the process cartridge or apparatus, and the toner bag cover 210 includes the slit 211 to receive the pulled portion 201*f* (flap 201*b*) inside the toner bag cover 210, the clamps 212 and 213 to sandwich the slit 211, configured to forcibly discharge toner from the bag body 201*a* moving between the clamps 212 and 213, and the connection face 214 to connect the slit 211 to the housing 204*a*. The toner bag cover 210 is designed to externally clamp and pull out the pulled portion 201*f* projecting from the slit 211. Accordingly, toner can be forcibly discharged from the toner bag 2011, and the empty toner bag 2011 can be collected in the toner bag cover 210. Thus, toner scattering or toner smear on user hands can be inhibited.

It is to be noted that the present invention is not limited to the specific embodiments described above, and numerous additional modifications and variations are possible in light of the above teachings. It is therefore to be understood that, the disclosure of this patent specification may be practiced otherwise by those skilled in the art than as specifically described herein, and such variations, modifications, alternatives are within the technical scope of the appended claims.

What is claimed is:

1. A powder refilling device comprising:

a refill powder chamber to accommodate a powder bag containing powder;

an opener to open the powder bag inside the refill powder chamber; and a squeezer to squeeze the opened powder bag to discharge powder therefrom and reduce a volume of the opened powder bag, wherein the squeezer presses the powder bag downward to secure space for another powder bag above the squeezed powder bag inside the refill powder chamber.

2. The powder refilling device according to claim 1, further comprising at least one additional squeezer.

3. The powder refilling device according to claim 1, wherein the squeezer comprises a handle to move the squeezer.

4. The powder refilling device according to claim 3, wherein the handle projects outside the toner chamber to be moved from outside the toner chamber.

5. The powder refilling device according to claim 1, further comprising a retainer to retain the squeezer at an initial position, and the squeezer is movable from the initial position to a squeezing position to reduce the volume of the powder bag.

6. The powder refilling device according to claim 1, further comprising a reel shaft having multiple projections arranged in a circumferential direction of the reel shaft to reel in the powder bag, wherein the powder bag comprises a containing portion to contain powder, and multiple holes spaced regularly are formed along both lateral ends of the containing portion, and while the reel shaft reels in the powder bag with the projections of the reel shaft inserted into the respective holes formed in the powder bag, the squeezer discharges powder from the powder bag.

7. A process cartridge removably installable in an image forming apparatus, the process cartridge comprising:

a developing device to develop with toner a latent image formed on an image bearer; and the powder refilling device according to claim 1.

8. A powder refilling device comprising:

a refill powder chamber to accommodate a powder bag containing powder;

an opener to open the powder bag inside the refill powder chamber;

a squeezer to squeeze the opened powder bag to discharge powder therefrom and reduce a volume of the opened powder bag; and an openably closable lid to open the refill powder chamber to place the toner bag inside the refill powder chamber, wherein the squeezer includes a pair of squeezing members facing each other to clamp the powder bag and discharge powder from the powder bag as the powder bag moves, the powder bag includes a containing portion to contain powder and disposed facing the opener when the powder bag is accommodated inside the refill powder chamber, and a pulled portion disposed facing the pair of squeezing members and partly projecting outside the refill powder chamber when the powder bag is accommodated inside the refill powder chamber, and as the powder bag is pulled out from a side of the pulled portion, the squeezers members squeeze toner out from the containing portion opened by the opener.

9. The powder refilling device according to claim 8, wherein the squeezing members are respectively provided to the lid and an interior of the powder refilling device, and the squeezing members are positioned to clamp the pulled portion of the powder bag when the lid is closed.

10. The powder refilling device according to claim 8, wherein the opener moves along a longitudinal direction of the powder bag.

11. The powder refilling device according to claim 8, wherein the pair of squeezing members is a pair of elastic rollers.

12. The powder refilling device according to claim 8, wherein the pair of squeezing members moves toward the opener.

13. The powder refilling device according to claim 8, wherein the powder bag further comprises a handle positioned at an end of the pulled portion, and when the pair of squeezing members moves toward the opener, the handle contacts an outer face of the lid and is inhibited from moving to the pair of squeezing members.

14. The powder refilling device according to claim 13, the handle comprises a rod having a diameter uniform in a longitudinal direction of the handle.

15. The powder refilling device according to claim 8, further comprising:

a powder bag cover to cover the toner bag, the power bag in which a slit is formed to receive the pulled portion of the powder bag; and a connection portion to connect the slit to a housing of the powder refilling device on an opening side of the lid, wherein the pair of squeezing members is provided to the powder bag cover and positioned adjacent to the slit.

16. The powder refilling device according to claim 15, wherein the connection portion is configured to connect together the powder bag cover and the housing in a sealed state.

17. An image forming apparatus in which a process cartridge including a toner refilling device is removably installable, the toner refilling device including a refill toner chamber to accommodate a toner bag containing toner, and a movable squeezer to squeeze the toner bag, the image forming apparatus comprising:

a cartridge mount in which the process cartridge is mounted; and a shifting assembly to move the squeezer of the toner refilling device, wherein the shifting assembly moves the squeezer in a direction to squeeze out toner from the toner bag into the toner chamber in conjunction with installation of the process cartridge into the image forming apparatus, and the shifting assembly returns the squeezer to an initial position to secure space for another toner bag in conjunction with removal of the process cartridge from the image forming apparatus.

18. The image forming apparatus according to claim 17, wherein the shifting assembly comprises:

a guide slot formed in an inner side wall of the toner refilling device;

a handle of the squeezer disposed to projects outside the toner refilling device through the guide slot and movable along the guide slot; and a cam groove formed in an inner side wall of the cartridge mount, the cam groove in which the handle fits movably.

* * * * *

UNITED STATES PATENT AND TRADEMARK OFFICE

CERTIFICATE OF CORRECTION

PATENT NO. : 9,042,778 B2
APPLICATION NO. : 13/930432
DATED : May 26, 2015
INVENTOR(S) : Saitoh et al.

It is certified that error appears in the above-identified patent and that said Letters Patent is hereby corrected as shown below:

On the title page, item (54) and in the specification, column 1, line 1, should read:
POWDER REFILLING DEVICE, PROCESS CARTRIDGE AND IMAGE FORMING APPARATUS INCLUDING SAME, AND POWDER REFILLING METHOD Signed and Sealed this
Fifteenth Day of March, 2016

Michelle K. Lee

Michelle K. Lee
*Director of the United States Patent and Trademark Office*